United States Patent [19]

Mester et al.

[11] 4,142,103

[45] Feb. 27, 1979

[54] X-RAY DIAGNOSTIC GENERATOR COMPRISING A DOSE RATE MEASURING DEVICE

[75] Inventors: Heinz Mester; Gerd Vogler, both of Hamburg, Fed. Rep. of Germany

[73] Assignee: U.S. Philips Corporation, New York, N.Y.

[21] Appl. No.: 852,696

[22] Filed: Nov. 18, 1977

[30] Foreign Application Priority Data

Nov. 24, 1976 [DE] Fed. Rep. of Germany ..... 2653252

[51] Int. Cl.[2] ..... H05G 1/46

[52] U.S. Cl. ..... 250/409; 250/322

[58] Field of Search ..... 250/408, 409, 322

[56] References Cited

U.S. PATENT DOCUMENTS 3,842,280 10/1974 Herrick ..... 250/409

*Primary Examiner*—Alfred E. Smith
*Assistant Examiner*—T. N. Grigsby
*Attorney, Agent, or Firm*—Thomas A. Briody; Jack E. Haken

[57] ABSTRACT

In an X-ray generator with dose rate control, useful for both tomographic exposures, i.e., exposures with a fixed, preset exposure time, and also for Bucky exposures when different limit times are preset for given organs; including a tube power control which prevents the tube limit power from being exceeded during dose rate control. During tube power control, the current and the voltage are changed in opposite directions with respect to each other, so that the dose rate can be changed while the tube power remains constant.

8 Claims, 2 Drawing Figures

X-RAY DIAGNOSTIC GENERATOR COMPRISING A DOSE RATE MEASURING DEVICE

Figure 1:
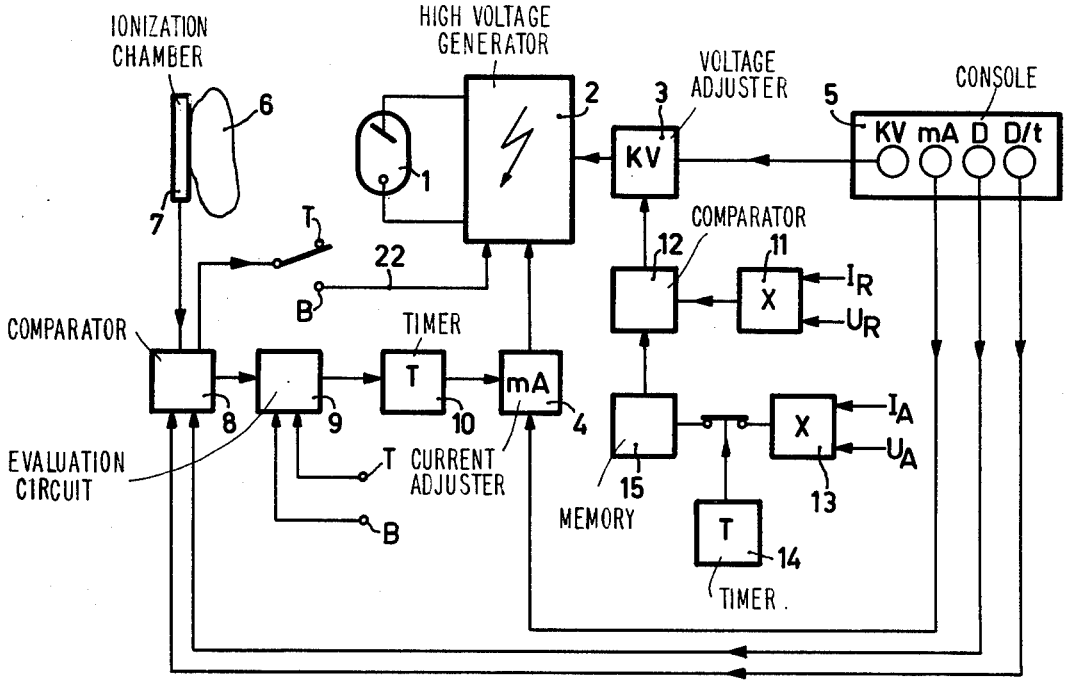

The invention relates to an X-ray diagnostic generator, comprising a dose rate measuring device and adjusting means for the tube current and the tube voltage, at least one of which is adjustable so that the difference between the measured actual value and a presettable reference value of the dose rate decreases.

An X-ray diagnostic generator of this kind is known from German Offenlegungsschrift No. 19 44 481. In this X-ray diagnostic generator, comprising a so-termed automatic organ exposure device, the tube voltage is increased when the measured dose rate becomes lower than a lower threshold value, and is decreased when the measured dose rate exceeds an upper threshold value, said threshold values being individually adjustable, together with the other exposure data such as tube voltage, density etc., for each organ by means of the automatic organ exposure device. When the tube voltage is increased, the tube power is also increased. Therefore, the power at the beginning of an exposure must be adjusted to a value which is substantially lower than the tube power which is permissible per se, in order to enable increases of this kind. However, this implies that in the case of exposures where the dose rate does not become smaller than the lower limit value, i.e., where the tube voltage is not to be increased, the available tube power is not completely utilized.

An X-ray diagnostic generator of the described kind, intended for an examining apparatus with presettable exposure time, for example, a tomography apparatus, is also known from German Offenlegungsschrift No. 19 46 036. The dose rate therein is adjusted to a reference value required for correct exposure by variation of the tube current, possibly also of the tube voltage, during the exposure. According to this dose rate control system, the tube power again changes. The operator who intends to make a series of tomographic images and who does not know whether the tube power has increased or decreased during the individual tomographic exposures, must then always assume that the tube power has been increased, so that a correspondingly longer interval until the next exposure must be introduced in order to prevent overloading of the tube. This interval, however, is unnecessarily long when, the tube power is actually not increased during an exposure, so that the available tube power is not completely utilized in this case either.

The present invention has for its object to construct an X-ray diagnostic generator of the kind described wherein better use of the tube power is ensured.

The X-ray diagnostic generator in accordance with the invention comprises a multiplier circuit which forms the product of the tube current and the tube voltage during the exposure, this product is applied to a comparison device which compares the product with a presettable tube power reference value and which acts on at least one adjusting member in order to control the tube power, the tube voltage and the tube current are changed in an opposite sense during control of the tube power. As a result of the oppositely directed variation of the tube voltage and the tube current, the tube power is maintained constant, while the dose rate is changed. This results in better use of the available tube power. When an X-ray diagnostic generator in accordance with the invention is used, for example, in a Bucky apparatus, the initially adjusted tube power may be chosen to be only slightly smaller than or even equal to the preset tube power reference value, which in this case corresponds to the rated power of the X-ray tube. In the case of tomographic exposures, the tube power reference value is chosen to be substantially lower than the value of the tube power which is permissible per se for the relevant layer exposure time. Thus, the proportioning of the intervals may always be based on this lower value. The tube power control may also be designed so that it becomes active only when an upper limit value is reached or exceeded.

Generally, the adjusting members for the tube current and the tube voltage have different time constants, i.e., they operate at a different speed, so that there are various possibilities for controlling these adjusting members in dependence of the dose rate or of the tube power respectively.

In accordance with a further aspect of the invention, the X-ray diagnostic generator the adjusting member having the larger time constant is controlled in direct dependence on the difference between the actual value of the dose rate and a reference value of the dose rate, the comparison circuit controlling the adjusting member having the smaller time constant. The fastest possible control of the tube power is thus achieved, whilst the dose rate varies more slowly in accordance with the time constant of the slower adjusting member.

In another embodiment suitable for use for X-ray diagnostic generators in which the adjusting member for the tube voltage has a time constant which is smaller than that of the adjusting member for the tube current, the adjusting member for the tube voltage is controlled in dependence of the dose rate, the adjusting member for the tube current being controlled by the comparison circuit. As a result, the dose rate can be very quickly adjusted to the required value, but the adjusting member for the tube current must then be capable of reducing the tube power so quickly that the tube is not overloaded when the tube power limit is briefly exceeded as the tube voltage is increased.

In an X-ray generator in accordance with the invention, many different loads may be required, depending on the X-ray tube, the focal spot, different programs, etc.; it is then necessary to supply all loads in the form of reference value signals to the comparison circuit. This is complex and expensive. Consequently an embodiment of an X-ray diagnostic generator in accordance with the invention comprises a further multiplier for the formation of a dose rate reference value and which multiplies the values of the tube voltage and the tube current, measured at the beginning of an exposure, by each other, the product being stored and utilized for forming the reference value.

The invention will be described in detail hereinafter with reference to the drawing.

Figure 2:
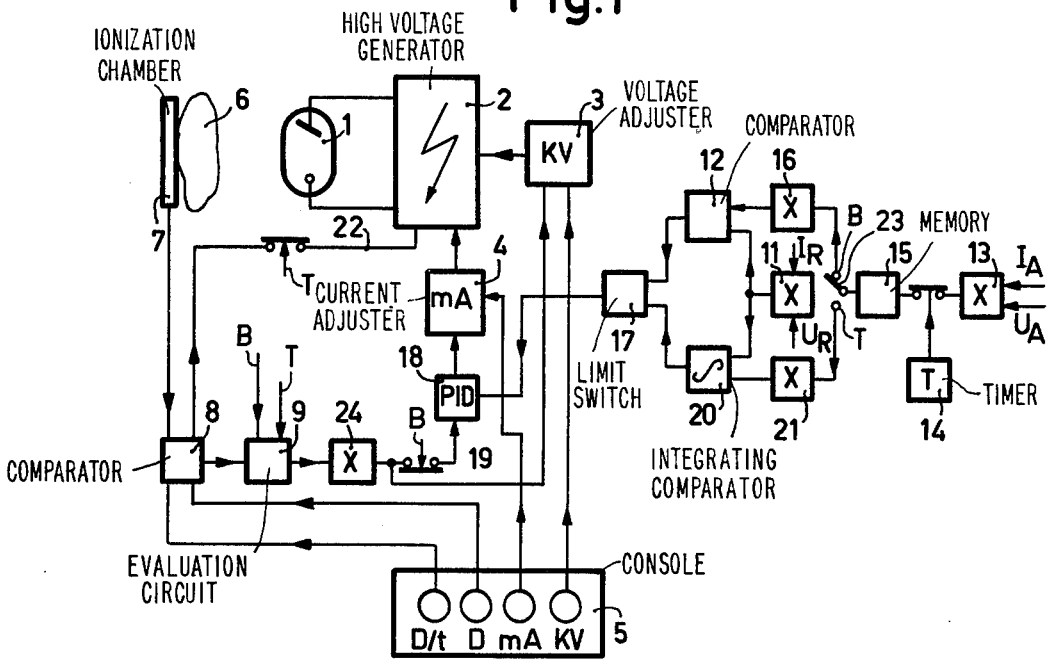

FIG. 1 is an embodiment of an X-ray diagnostic generator in accordance with the invention in which the tube power is continuously controlled, and FIG. 2 is an embodiment of an X-ray diagnostic generator in accordance with the invention in which the tube power is only controlled when it reaches or exceeds an upper limit value.

FIG. 1 shows an X-ray tube 1 which is powered by a high voltage generator 2. The tube voltage is controlld by the adjusting member 3, the tube current being controlled by the adjusting member 4. Both adjusting members receive their signals for the initial values from a console 5. The presettings of the initial values of the tube voltage and the tube current may be coupled to each other. The dose rate and the switch-off dose or the exposure time can also be preset by the same operation. These quantities, however, can also be separately chosen. When the X-ray generator is utilized in combination with a tomography apparatus, the dose rate follows from the time required for the X-ray tube and the recording device to execute the blurring pattern, and from the switch-off dose which in turn is determined from the density of the film.

When the high voltage generator 2 is switched on by way of means not shown, the X-ray tube 1 operates at the selected voltage and the associated tube current, the patient 6 is irradiated, and the dose rate or the dose is measured by means of the measuring member 7, for example, an ionization chamber. The output signal of the measuring member 7 is applied to a comparison device 8 and is compared with the reference value (values) for the dose rate supplied by the console 5. When the signal supplied by the measuring member 7 is proportional to the dose rate, the reference value supplied by the console 5 must be a constant signal (direct voltage or direct current). However, if the output signal of the measuring member 7 is proportional to the dose, it increases, ramp-like, in the time. It is then compared in the comparison device 8 with a signal which also increases ramp-like and which represents the reference value for the dose. In addition, the comparison device 8 compares the dose measured behind the object during the exposure with the switch-off dose and, in the case of Bucky exposures, i.e., exposures without predetermined exposure time, it supplies a switch-off signal to the high voltage generator via the line 22.

The signal which is dependent of the difference between the measured dose rate and the desired dose rate is applied to an evaluation circuit 9 which controls the adjusting member 4 for the tube current via a timing member 10. The evaluation circuit 9 is constructed so that it always initiates a control procedure for a tomographic exposure when a difference exists between the actual value and the reference value for the dose rate. In the case of Buckey exposures, i.e., exposures without predetermined exposure time, a control procedure is started only if the measured actual value of the dose rate deviates from the reference value for the dose rate by a given amount in the positive or negative sense, i.e., dose rate control is initiated only when an upper threshold value is exceeded or when dose rate is lower than a given lower limit value, as is known from German Offenlegungsschrift No. 19 44 481. The timing member 10 ensures that control of the tube current adjusting member 4 can commence only some milliseconds after the start of the exposure, when the values of tube voltage and tube current adjusted on the console, are actually present at the X-ray tube 1.

The adjusting member 5, which is assumed to have the larger time constant, is controlled by the evaluation circuit 9 so that when the measured dose rate deviates from the desired dose rate or the dose rate ranges in the negative direction, the tube current is decreased, the tube current being increased if the measured dose rate deviates from the desired dose rate or the desired dose rate ranges in the positive direction. The difference between the measured and the desired dose rate value is then increased, but the difference will decrease due to a change of the tube voltage in order to keep the tube power constant.

For this purpose there is provided a control circuit which comprises a multiplier circuit 11 which forms the product of the tube current $I_R$ flowing through the X-ray tube 1 and the voltage $U_R$ present on the X-ray tube. The output signal of the multiplier circuit 11, corresponding to the actual value of the tube power, is applied to a comparison circuit 12 which compares the actual value with a presettable reference value. This reference value is produced by a further multiplier circuit 13 which forms the product of the values $I_A$ and $U_A$ prevailing at the start of an exposure. A timing member 14 ensures that the output signal of the multiplier circuit 13 is stored in a memory 15 a few milliseconds after the start of the exposure, said output signal being extracted from said memory after the values of the tube voltage and the tube current, adjusted on the console 5, are actually present on the X-ray tube, before the actual control process starts. The value stored in the memory 15 thus corresponds to the product of the values of tube voltage and tube current adjusted on the console 5.

This value is applied as a reference value to the comparison circuit 12 which controls the adjusting member 3 for the tube voltage, (which has a time constant smaller than that of the adjusting member 4 for the tube current) which comprises, for example, a control tetrode, so that the product remains constant.

Thus, control commences after expiration of the period after the start of exposure determined by the timing members 10 and 14, first the control current is varied and subsequently, in an opposite sense, the tube voltage, until the actual dose rate corresponds to the reference dose rate, or until a safety circuit (not shown) interrupts the control process due to the exceeding of limit values of the tube current or the tube voltage. In the case of a decreasing load, where the tube current is automatically decreased after expiration of a defined period of time after the start of exposure (generally 100 ms), the control process is also interrupted before the automatic decreasing, the tube voltage at that time being maintained.

The X-ray generator shown in FIG. 2 substantially corresponds to the generator shown in FIG. 1, except that the tube voltage adjusting member 3 is controlled in dependence of the dose rate, while the tube current adjusting member 4, which has a time constant larger than that of the tube voltage adjusting member 3, is controlled in dependence on the tube power. The tube power is controlled only when a power limit value is reached or exceeded. Thus, for tube powers below this limit power, the tube current may be controlled in the same direction as the tube voltage, in dependence of the dose rate, for dose rate control, which is of importance for tomography exposures.

Accordingly, the control signal on the output of the evaluation circuit, which is dependent of the difference between the measured dose rate and the preset dose rate, is applied, via a PID controller 24 (i.e., a controller whose output signal is proportional to the sum of the input signal, the differential quotient of the input signal and the integral of the input signal), to the tube voltage adjusting member 3. Dose rate control may commence a few milliseconds after the start of the exposure when the adjusted values of the tube current and the tube voltage are present on the X-ray tube 1. For this purpose, a further timing member (not shown) may be provided, for example, between the evaluation circuit and the PID controller 24.

The tube power control becomes effective only when an upper limit value of the tube power is reached or exceeded. The reference value corresponding to the tube power limit value must be slightly larger than the tube power at the beginning of the exposure. Consequently, a further multiplier circuit 16 is provided between the output of the memory 15 and an input of the comparison circuit 12 in which the output signal of the multiplier stage 13 which multiplies the tube current and the tube voltage by each other at the beginning of the exposure, is stored after a period of time which is dictated by the timing member 14. The multiplier circuit 16 multiplies the value stored by a factor which is slightly larger than 1, for example, 1.1. The stored value is applied to the multiplier circuit 16 via a switch 23.

Control takes place only when the tube power determined during the exposure is higher than the tube power limit value thus formed, the tube current is then decreased until the dose rate reaches the prescribed value and the tube power is no longer exceeded. The adjusting member 4 is controlled by the comparison stage 12 via a switch 17 and the PID controller 18.

For making tomographic images, the input of the PID controller 18 is connected, via a switch 19 (which is closed during layer image exposure) to the output of the multiplier 24. The operation is then as follows.

When the actual value of the dose rate deviates from the dose rate reference value during a tomographic exposure, a difference signal occurs which controls the adjusting member 3 for the tube voltage (which operates substantially faster than the control member 4 for the tube current and comprises, for example, a control tetrode) so that the difference between the two said dose rate values is decreased. During the starting phase, the control of dose rate is thus exclusively effected in dependence on the tube voltage, so that fast control of the dose rate achieved but the image character is changed due to the change of the radiation hardness. The output of the multiplier 23 is connected, via the switch 19 and the PID controller 18, to the input of the tube current adjusting member 4 and controls the tube current in the same direction as the tube voltage, i.e., the tube current is increased (like the tube voltage) when the dose rate measured is too low. Due to the component which is proportional to the integral of the input signal and which is included in the output signal of the controller 18, the control of the tube current adjusting member continues after the adjusting quantity on the output of the PID controller 24 has returned to zero, so that if the differences in dose rate are not too large, the tube voltage has substantially reached its value at the beginning of the exposure. Consequently, during an exposure, dose rate control is gradually taken over by the tube current adjusting member 4. If the tube current increases so much that the permissible tube limit power is reached or exceeded, a limit switch 17 is activated, so that the take over is stopped or the tube current is reduced in accordance with the power limit of the X-ray tube.

If the adjusting member 4 has an integrating action the same effect can be achieved with a PID controller 18 wherein the output signal has a constituent which is proportional to the differential quotient and the input signal itself. Such an integrating action may result, for example, if the controller includes an adjusting motor. The PID controller can also be dispensed with if the adjusting member 3 has an integrating effect.

The risk of the tube limit power being exceeded during a tomographic exposure, which may have a duration of several seconds, is comparatively small. First of all, the medium power which may be converted into heat in the X-ray tube during a tomographic exposure is lower than the maximum permissible power (which may usually be applied to the tube for only 0.1 second), while on the other hand the power at which the exposure is started is, for example, a factor 3 smaller than the said medium value, so that dose rate deviations can be eliminated in the positive as well as in the negative direction via the current. Consequently, in the case of a tomographic exposure the comparison circuit 12 will generally not be activated. Therefore, it is more important that the medium value of the tube power is below the permissible mean value during the exposure.

To this end, there is provided a further comparison circuit 20 which integrates the difference between the actual value and the reference value and which controls the PID controller 18, via the switch 17, in dependence of the integral value of this difference. The actual value of the tube power is applied to the comparison circuit 20 from the output of a multiplier circuit 11, while the reference value is applied via a multiplier circuit 21 which multiplies the value of the starting power stored in the memory 15 by a constant factor. This factor must be larger than 1 (otherwise, tube power control will commence at the start of the exposure) and smaller than the quotient of the medium value of the tube power permissible during an exposure and the tube power $I_A \cdot U_A$ adjusted at the beginning. If the factor is chosen so that it is approximately equal to the said quotient, the dose rate can be readjusted over a comparatively wide range by variation of the tube current in the case of a tomographic exposure, but the permissible tube power can then be fully utilized in the case of a single exposure, so that in the case of a series of layer exposures the operator must wait for a comparatively long period of time before the start of the next exposure. However, if the factor is chosen to be near to 1, shorter intervals are possible, while the maximum achievable medium value of the tube power during an exposure is lower, but dose rate deviations can be eliminated in a comparatively small range by variation of the tube current.

What is claimed is:

1. An X-ray diagnostic generator, comprising a dose rate measuring device and adjusting means for X-ray tube current and X-ray tube voltage, at least one of said adjusting means functioning so that the difference between the measured actual value and a presettable reference value of the dose rate decreases comprising, as an improvement a multiplier circuit which forms the product of the tube current and the tube voltage during an exposure, said product being applied to first comparison means which compare the product with a presettable tube power reference value and which act on at least one of said adjusting means to control the tube power, the tube voltage and the tube current being changed in an opposite sense during control of the tube power.

2. An X-ray diagnostic generator as claimed in claim 1, further comprising a further multiplier circuit, for the formation of the tube power reference value, which multiplies values of the tube voltage and the tube current measured at the beginning of an exposure, by each other, the product being stored in a memory, the output signal of which is used to form said reference value.

3. An X-ray diagnostic generator as claimed in claim 1 in which the adjusting means have different time constants, and wherein the adjusting means having the larger time constant is controlled in directly dependence of the difference between the actual value of the dose rate and the reference value of the dose rate and the first comparison means control the adjusting means having the smaller time constant.

4. An X-ray diagnostic generator as claimed in claim 3, wherein for any deviation of the actual value of the tube power from the reference value, the first comparison means controls the adjusting means having the smaller time constant so as to maintain the tube power constant at the tube power reference value.

5. An X-ray diagnostic generator as claimed in claim 1, in which the adjusting means for the tube voltage has a time constant which is smaller than that of the adjusting means for the tube current, wherein the adjusting means for the tube voltage is controlled in dependence of the dose rate and the adjusting means for the tube current is controlled by the first comparison means.

6. An X-ray diagnostic generator as claimed in claim 1, wherein the tube power is controlled only when an upper limit value of the tube power is exceeded.

7. An X-ray diagnostic generator as claimed in claim 6, for tomographic exposures; further comprising second comparison means which integrate the difference between the actual value and the reference value of the tube power and which function to cause a variation of the tube power in dependence of the time integral of this difference.

8. An X-ray diagnostic generator as claimed in claim 6, for tomographic exposures, wherein the control signal for the tube voltage adjusting means is also applied, via a PID controller, to the tube current adjusting means, and said control signal does not act on the tube current adjusting means when the limit value of the tube power is exceeded.

* * * * *